United States Patent [19]

Dumoulin et al.

[11] Patent Number: 4,525,993

[45] Date of Patent: Jul. 2, 1985

[54] TWISTING MACHINE

[75] Inventors: André Dumoulin, Montagnes; Marc Séguin, Ile Perrot; Jean Bouffard, Lachine, all of Canada

[73] Assignee: Northern Telecom Limited, Montreal, Canada

[21] Appl. No.: 565,632

[22] Filed: Dec. 27, 1983

[51] Int. Cl.[3] ..... D01H 1/10; D01H 7/86

[52] U.S. Cl. ..... 57/58.52; 57/58.7; 57/59; 474/93

[58] Field of Search ..... 57/59-65, 57/58.49, 58.52, 58.54, 58.55, 58.57, 58.59, 58.61, 58.63, 58.65, 58.67, 58.68, 58.7, 314; 474/91, 93; 226/188

[56] References Cited

U.S. PATENT DOCUMENTS 1,358,205 11/1920 Heydon ..... 474/93 X 3,238,711 3/1966 Lundgren ..... 57/58.52

3,349,553 10/1967 Hood ..... 57/58.7

3,715,877 2/1973 Akachi ..... 57/63 X 3,789,684 2/1974 Freier ..... 474/93 X

FOREIGN PATENT DOCUMENTS 19346 9/1896 United Kingdom ..... 474/93

*Primary Examiner*—Stuart S. Levy

*Assistant Examiner*—Joseph J. Hail, III

*Attorney, Agent, or Firm*—R. J. Austin

[57] ABSTRACT

Twisting machine with a guide pulley for filamentary material and which is rotatable about its own axis and about a second axis causing air to impinge on one of the pulley sides. Impeller surfaces extend inwardly from the pulley rim to axis in rotating the pulley because of air impingement. Conveniently, the impeller surfaces are formed on spokes of the pulley.

4 Claims, 3 Drawing Figures

TWISTING MACHINE

This invention relates to twisting machines for indefinite lengths of filamentary material.

In the twisting of filamentary material, frictional contact between the material being twisted and machine parts performing the twisting operation and creating a drag upon movement of the material along its feed path, cause a build up in tension applied to the material. In at least some twisting procedures, this tension build up is disadvantageous and should be minimized as much as possible.

In one particular process, reduction in tension during twisting would be beneficial. In this process, insulated conductors are twisted together in twisted units or pairs during the manufacture of telecommunications cable. Cable core includes many pairs, e.g. up to 3600, of insulated conductors. In the manufacture of cable core, the summation of tension applied to the conductors of all of the twisted pairs (e.g. with a tensile load in the region of 4 lbs. per conductor), makes the total load unmanageable whereby stranding of the twisted pairs into the core and in tandem with the twisting operation is highly impractical. Any manner of reducing tension in the insulated conductors during twisting of them into pairs would assist in rendering a practical realization for the pair twisting and core stranding operation to be performed in tandem (sometimes referred to as "in-line").

This invention relates to a twisting machine having features designed to reduce the tension in filamentary material during twisting.

According to the present invention, a twisting machine for filamentary material has a guide pulley freely rotatably mounted about a first axis upon a support which is rotatable about a second axis, the pulley having a rim portion defining a peripheral guide channel for the material and a plurality of impeller surfaces extending inwardly of the rim portion and facing from one side of the pulley at an angle to the first axis whereby flow of air impinging upon the impeller surfaces and at said one side of the pulley applies a rotational force upon the pulley around said first axis, and the pulley lies in a plane extending in a direction having a radial component to the second axis to cause air to impinge upon said surfaces during rotation of the support and pulley about the second axis.

In a preferred construction, the pulley has arms which define the impeller surfaces, the arms being spaced apart around the pulley by gaps extending through the pulley. To produce the impeller surfaces in a manner convenient to manufacture, the arms are of substantially constant cross-sectional shape along their lengths, with each impeller surface substantially planar and each arm is inclined to the axis of the pulley.

One embodiment of the invention will now be described by way of example, with reference to the accompanying drawings, in which.

Figure 1:
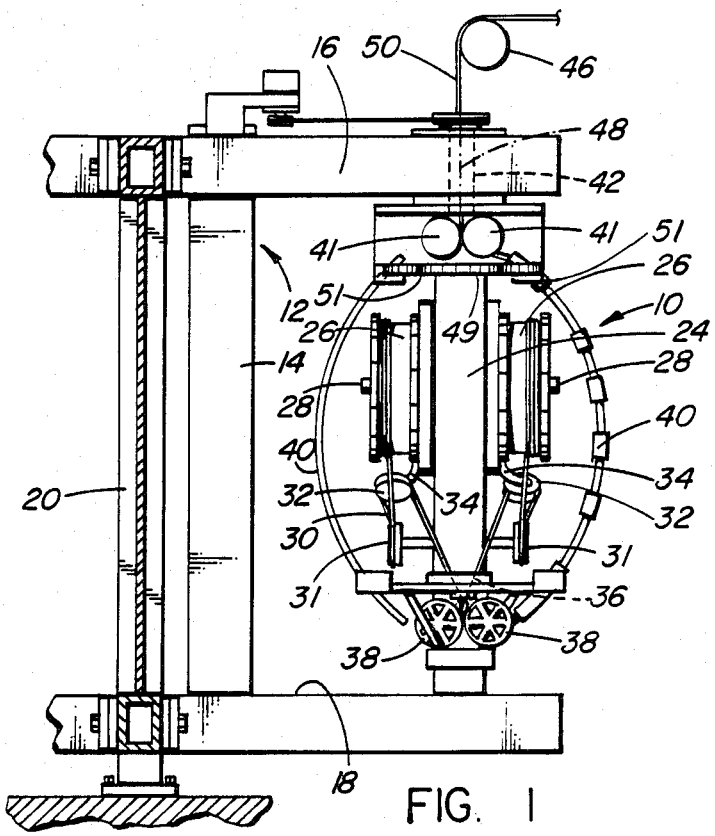
FIG. 1 is a side elevational view of part of a twisting head of a twisting machine for forming twisted insulated conductor pairs.

As shown by FIG. 1, a twisting machine 10 is carried in a 'c' shaped rigid frame 12 comprising a vertical member 14 and spaced upper and lower horizontal frame members 16 and 18. The frame is detachably bolted to a vertical main frame 20. The main frame carries a plurality of identical frames 14 and twisting machines 10 and the whole arrangement is described in greater detail in a copending patent application Ser. No. 565,760 entitled "Apparatus for Twisting Insulated Conductors" and filed concurrently herewith in the names of J. Bouffard, A. Dumoulin and O. Axiuk.

Each twisting machine comprises a vertical reel cradle 24 held in fixed position between the cross members 16 and 18. The structure 24 rotatably carries two spools 26 of insulated electrical conductor on shafts 28. In conventional manner, each insulated conductor 30 is drawn from its spool, around a guide roll 31, around a dancing roller 32 carried upon pivotal arm 34, through a lower aperture 36 of cradle 24, then together around one of two guide pulleys 38, through one of two upwardly extending flyers 40, around a guide pulley 41 and through upper aperture 42 before passing around a single pulley 46 and away from the twisting machine. The flyers 40 are rotated in diametrically opposed positions around a vertical axis 48 as is more fully described in copending patent application Ser. No. 565,635, entitled "Twisting Machine" and filed concurrently herewith in the names of J. Bouffard, A. Dumoulin and O. Axiuk. As described in that application, the two flyer bars and associated pulleys provide a balanced rotational structure while avoiding conventional balancing masses. During rotation of the flyers, the cradle 24 together with spools 26, guide rolls 31 and dancing rollers 32 is held stationary, in known manner for twisting machines, by sun and planet gears 49 and 51. The rotational movement of the flyers imposes a twist upon each conductor 30 such that the conductors twist together to form a twisted pair 50 and it is in this condition that they move around pulley 46.

Figure 2:
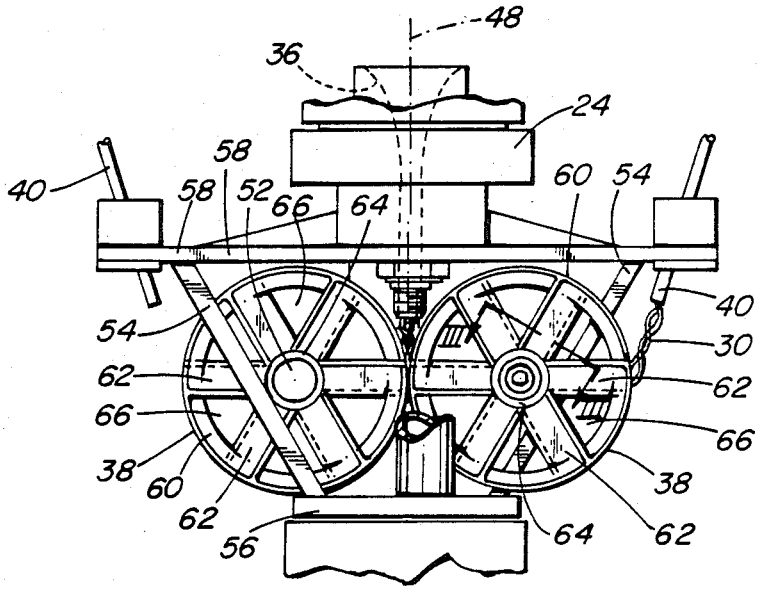
FIG. 2 is a view of part of the head of FIG. 1, on larger scale and showing greater detail.

As is shown more clearly by FIG. 2, each of the guide pulleys 38 is freely rotatably mounted upon a horizontal axis in a bearing carrier 52 secured to a frame member 54 which extends obliquely between lower and upper platforms 56, 58. Lower ends of the flyers 40 are secured to the upper platform which, together with the lower platform and the guide pulleys 38, is rotated around vertical axis 48 with the flyers. As shown, the guide pulleys 38 also lie in planes extending substantially in a radial direction to the axis 48. Hence, each guide pulley is rotatable around axis 48 with one side of the pulley facing in the direction of rotation about that axis.

Figure 3:
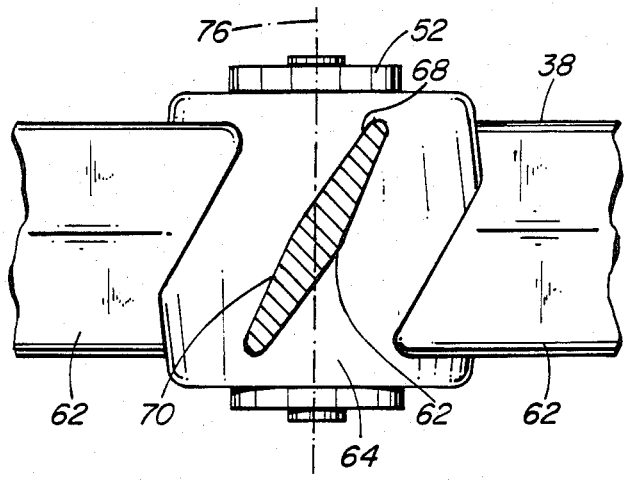
FIG. 3 is a cross-sectional view taken along line III—III in FIG. 2.

Although the guide pulleys 38 are freely rotatable about their horizontal axes, frictional contact between bearing parts and between a 'V'-shaped guide channel provided in a rim portion 60 of each pulley and insulated conductor 30 passing around it, places a drag upon the movement of each conductor along its path and is one of the reasons for a build up in tension in the conductor. Each of the guide pulleys is provided with a means to counteract the effects of the frictional contact and hence reduces the drag and tension build up. This means is in the form of impeller surfaces which face in the direction of rotation of each pulley about axis 48, these surfaces lying at an angle to the horizontal axis of the pulley whereby flow of air impinging upon the impeller surfaces during pulley rotation about axis 48, applies a rotational force upon the pulley. More particularly, as shown by FIGS. 2 and 3, each pulley 38 is formed with six radial arms or spokes 62 which extend inwardly from the guide channel 60 to a central boss 64, the arms defining gaps 66 between them. As shown by FIG. 3, each arm 62 is generally of planar strip form. One side of each arm has two flat surfaces 68 and 70 which are slightly inclined relative to each other from a central plane of the arm, these surfaces 68 and 70 forming impeller surfaces for one direction of travel of the pulley around axis 48. Each arm is inclined at approximately 30° to the axis 76 of its pulley (see FIG. 3).

In use of the machine, the flyers and pulleys 38 and 41 are rotated in the appropriate direction around axis 48 to produce the direction of twist required in the conductors 30. As rotation takes place around axis 48, one of the two pulleys 38 is rotated about its horizontal axes by passage of the conductors 30 around it and then up the corresponding flyer. In effect, therefore, pulley 38 in the position shown to the right of FIG. 2 rotates anticlockwise about axis 76. Hence, the direction of rotation about axis 48 is such that the pulley 38 on the right hand side is moving upwardly from FIG. 2 while the other pulley is moving downwardly.

Rotation of the pulleys 38 about axis 48 in the appropriate direction, assists in pulley rotation as desired about axis 76. Rotation about axis 48 presents the impeller surfaces 68 and 70 at the inclined angle of 30° to the flow of air through the gaps 66 whereby the air flow creates a component of force upon each impeller surface which is a rotational force upon each pulley. The rotational movement caused by the air flow is sufficient to overcome frictional force in the bearings of the pulleys and which normally offers a resistance to pulley rotation. It follows that the frictional resistance in these bearings is significantly reduced and does not add to tension build up in the insulated conductors as they are drawn along their paths. Hence, the tension build up in the twisted pair of conductors drawn through the machine of the embodiment is below that in use of an identical machine in which no impeller surfaces are provided upon the pulleys.

What is claimed is:

1. A twisting machine for filamentary material having a guide pulley freely rotatably mounted about a first axis upon a support which is rotatable about a second axis, the pulley having a rim portion defining a peripheral guide channel for the material and a plurality of impeller surfaces extending inwardly of the rim portion and facing from one side of the pulley at an angle to the first axis whereby flow of air impinging upon the impeller surfaces and at said one side of the pulley applies a rotational force upon the pulley around said first axis, and the pulley lies in a plane extending in a direction having a radial component to the second axis to cause air to impinge upon said surfaces during rotation of the support and pulley about the second axis.

2. A twisting machine according to claim 1 wherein the pulley has arms which define the impeller surfaces and the arms are spaced apart around the pulley by gaps extending through the pulley.

3. A twisting machine according to claim 2 wherein the arms are of substantially constant cross-sectional shape along their lengths.

4. A twisting machine according to claim 3 wherein each impeller surface is substantially planar.

* * * * *